US005361432A

United States Patent [19]

Shamie

[11] Patent Number: 5,361,432

[45] Date of Patent: Nov. 8, 1994

[54] LOCK BRACKET ASSEMBLY

[76] Inventor: Louis Shamie, 972 Dean St., Brooklyn, N.Y. 11238

[21] Appl. No.: 121,788

[22] Filed: Sep. 15, 1993

[51] Int. Cl.[5] ..... A47C 19/02; A47D 7/03

[52] U.S. Cl. ..... 5/11; 5/73.1; 5/207

[58] Field of Search ..... 5/11, 93.1, 207, 208

[56] References Cited

U.S. PATENT DOCUMENTS

| | | | |
|---|---|---|---|
| 3,634,894 | 1/1972 | Harbison | 5/93.1 X |
| 3,760,434 | 9/1973 | Neunherz et al. | 5/11 |
| 3,896,514 | 7/1975 | Feldstein | 5/11 X |
| 4,639,956 | 2/1987 | Shamie | 5/93.1 |
| 4,744,114 | 5/1988 | Simpson et al. | 5/97.1 X |
| 4,825,482 | 5/1989 | Paris | 5/207 |

*Primary Examiner*—Michael F. Trettel
*Attorney, Agent, or Firm*—Burgess, Ryan and Wayne

[57] ABSTRACT

A lock bracket assembly for securing a mattress support member of a crib to a headboard of the crib, includes an elongated bracket having a plurality of slots therein secured to the headboard, each slot having an enlarged mouth portion and a lower base portion in open communication with the enlarged mouth portion; a bar secured to the mattress support member, the bar having at least one mounting pin for insertion within at least one respective slot so as to mount the mattress support member to the headboard; and lift-prevention means for preventing escape of each mounting pin from the respective slots, the lift-prevention means including a lift-prevention opening in the bracket and an extension which is secured to the bar and which extends into the lift-prevention opening when the at least one mounting pin is inserted within the at least one respective slot.

8 Claims, 4 Drawing Sheets

LOCK BRACKET ASSEMBLY

BACKGROUND OF THE INVENTION

The present invention relates generally to locking devices, and more particularly, is directed to a lock bracket assembly having particular applicability to cribs.

U.S. Government standards require that mattress spring supports should not be capable of being pushed up by a predetermined upward force applied thereto. Otherwise, a child playing by the crib could be injured.

Conventional cribs include two standard bars or the like secured to each headboard. Each standard bar contains slots therein for receiving mounting pins connected to corners of the mattress spring support. In this manner, the mattress spring support is supported by the standard bars. In order to prevent the mattress spring support from being lifted up by a child, downwardly extending hooks are provided on the standard bars and hook onto lift-prevention pins secured to the mattress spring support. Therefore, after the mounting pins are fit within the slots of the standard bars, the hooks are forced over and secured to the lift-prevention pins, to prevent a child from lifting up the mattress spring support.

However, this requires an additional securing step, and such step requires a force fit of the hooks over the lift-prevention pins which may sometimes be difficult to perform. Further, such assembly requires too many additional elements, and requires additional space for mounting these additional elements.

OBJECTS AND SUMMARY OF THE INVENTION

Accordingly, it is an object of the present invention to provide a lock bracket assembly that overcomes the aforementioned problems with the prior art.

It is another object of the present invention to provide a lock bracket assembly that automatically locks the mattress spring support to the headboard to prevent unintentional lifting up of the mattress spring support, when the mattress spring support is mounted to the headboard.

It is still another object of the present invention to provide a lock bracket assembly that is easy and economical to make and use.

In accordance with one aspect of the present invention, a lock bracket assembly for securing first and second members together, includes an elongated bracket having a plurality of slots therein secured to the first member, each slot having an enlarged mouth portion and a lower base portion in open communication with the enlarged mouth portion; at least one mounting pin connected with the second member for insertion within at least one respective slot so as to mount the second member to the first member; and lift-prevention means for preventing escape of the at least one mounting pin from the at least one respective slot, the lift-prevention means including a lift-prevention opening in the bracket and extension means, which is connected with the second member, for extending into the lift-prevention opening when the at least one mounting pin is inserted within the at least one respective slot.

Specifically, a bar is connected with the second member, with the at least one mounting pin and the lift-prevention means being mounted on the bar. Preferably, the bar is pivotally connected with the second member.

Also, the at least one mounting pin and the lift-prevention means extend from the same side of the bar.

In one embodiment, the lift-prevention means includes a flat spring member having one end secured to the bar so as to lie against the bar, and an opening in the bar and the extension means includes a lift-prevention pin secured to a free end of the flat spring member and extending through the opening in the bar for engagement with the lift-prevention opening.

In a second embodiment, the lift-prevention means includes a threaded opening in the bar and the extension means includes a bolt threadedly engaged within the threaded opening for engagement with the lift-prevention opening.

Preferably, the lift-prevention opening is the same as one open mouth portion.

The present invention has particular applicability to a crib, so that the first member is a headboard of the crib and the second member is a mattress support member of the crib.

The above and other objects, features and advantages of the invention will become readily apparent from the following detailed description thereof which is to be read in connection with the accompanying drawings.

DETAILED DESCRIPTION OF THE PREFERRED EMBODIMENTS

Before discussing the present invention, it will be appreciated that although the lock bracket assembly of the present invention is particularly applicable for use with cribs, the present invention is not limited thereby. Thus, the lock bracket assembly according to the present invention has many other uses.

Figure 1:
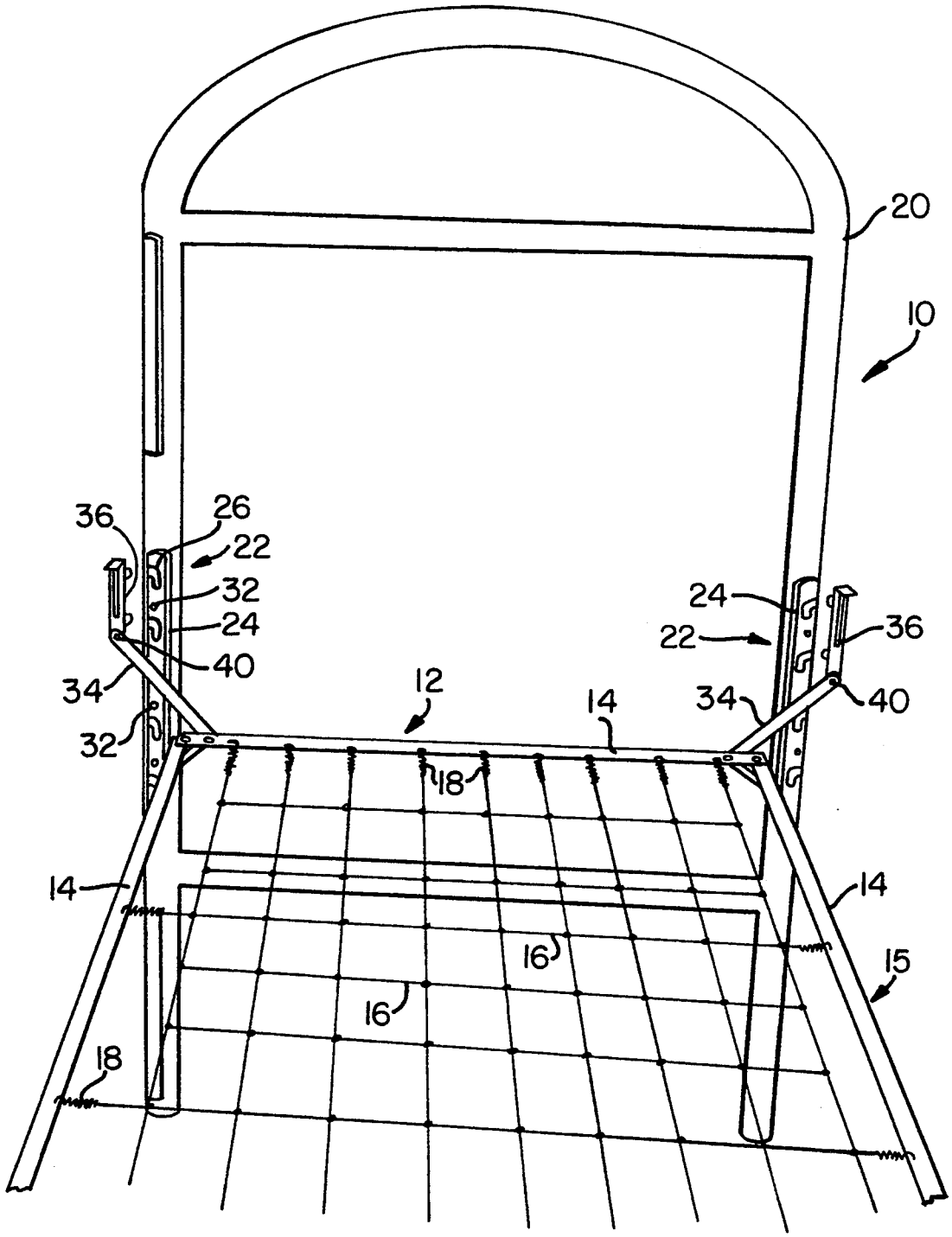
FIG. 1 is a perspective view of a portion of a crib using lock bracket assemblies according to a first embodiment of the present invention.

Now, referring to the drawings in detail, and initially to FIG. 1 thereof, a crib 10 includes a rectangular mattress spring support or base 12. As shown, mattress spring support 12 includes four outer metal frame members 14 which are secured together to form a rectangular frame 15, and a plurality of mattress support wires 16 stretched across the frame members 14 and secured thereto via coil springs 18.

Opposite frame members 14 are secured to respective opposite headboards 20 of crib 10, and the manner of securement therebetween is the subject of the present invention. It is also noted that side rails (not shown) are provided adjacent the remaining two opposite frame members 14 and are secured between the opposite headboards 20 for raising and lowering.

Figure 2:
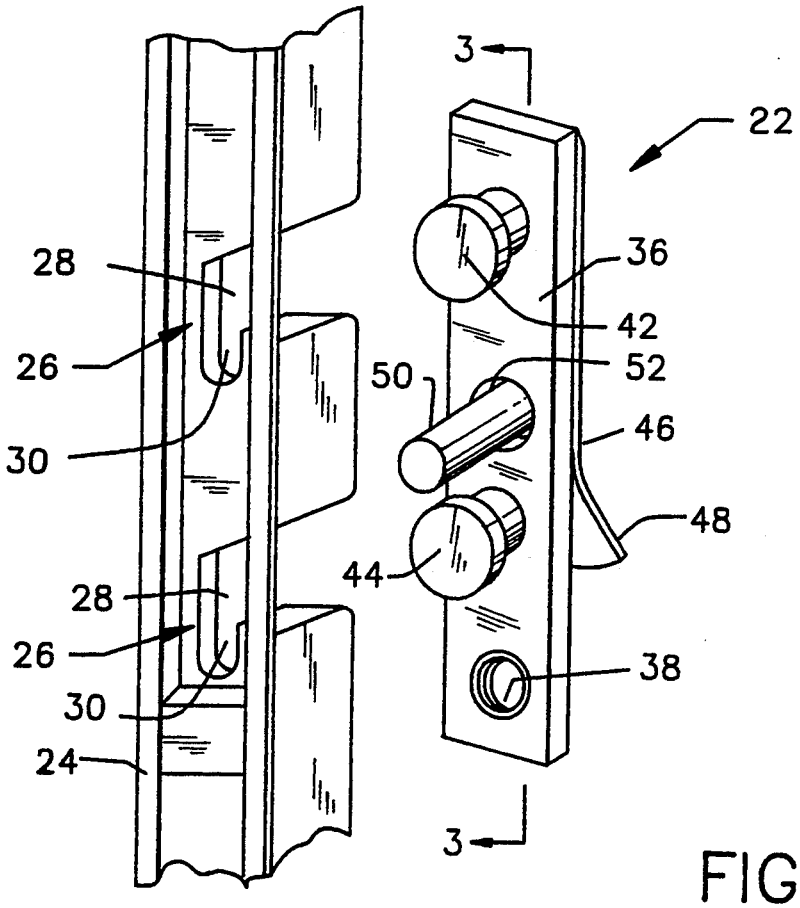
FIG. 2 is an enlarged perspective view of one lock bracket assembly of FIG. 1.

Thus, there are four lock bracket assemblies 22, with two secured to opposite inner sides of one headboard 20 and the remaining two secured to opposite inner sides of the other headboard 20. As shown in FIGS. 1 and 2, each lock bracket assembly 22 includes a vertically oriented, elongated bracket or standard bar 24 having a plurality of vertically spaced open ended slots 26. Each slot 26 has an open mouth 28 and a blind base 30 which is positioned below the mouth 28 of each slot. As is apparent from FIG. 1, the open mouths 28 of each bracket 24 face outwardly of the space defined by the crib frame, that is, the open mouths 28 on opposite brackets 24 on the same headboard 20, face away from each other. However, such open mouths 28 could just as well be in facing relation to each other. Holes 32 are provided in brackets 24 for securing the same to the headboards 20 by screws (not shown) or the like.

A first pivot bar 34 is pivotally secured to each corner of rectangular frame 15, and a second pivot bar 36 is pivotally secured to the free end of each first pivot bar 34. In this regard, each pivot bar 34 and 36 has a mating opening 38 through which a pivot pin 40 is secured to pivotally secure pivot bars 34 and 36 together.

Figure 3:
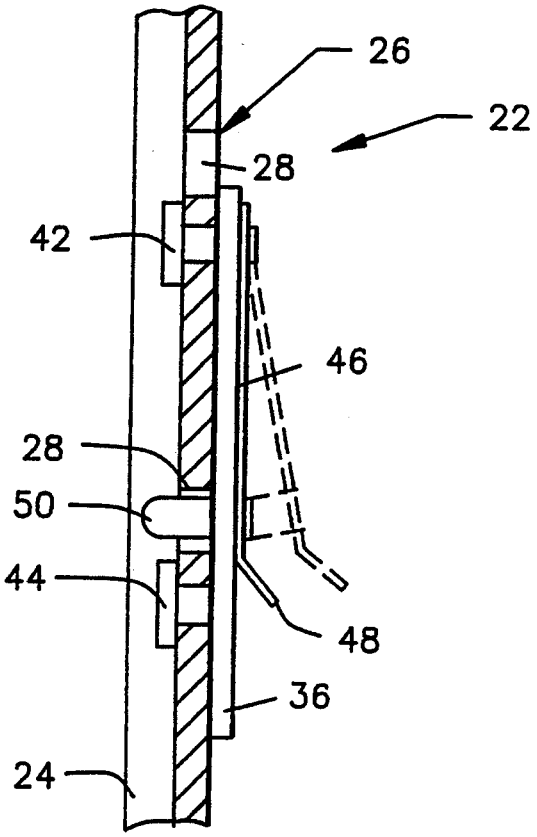
FIG. 3 is a cross-sectional view of the lock bracket assembly of FIG. 2 in assembled condition, taken along line 3—3 thereof.

As shown in FIGS. 2 and 3, two spaced mounting pins 42 and 44 are provided on the outwardly facing surface of each second pivot bar 36. In this manner, by positioning the mounting pins 42 and 44 within open mouths 28 of respective slots 26 and then into the blind bases 30 thereof, mattress spring support 12 is held by headboards 20 at a desired height.

However, with this arrangement, it is possible for a child to push the mattress spring support 12 up, and thereby release mounting pins 42 and 44 from slots 26. This, however, can be dangerous for a child, and is also contrary to U.S. Government standards.

Therefore, in accordance with a first aspect of the present invention, a flat spring member 46 has one end secured to the opposite surface of each second pivot bar 36 by means of the upper mounting pin 42 thereof. Thus, flat spring member 46 lies flat against this opposite surface of each second pivot bar 36. The lower end 48 of flat spring member 46 is outwardly bent so as to enable it to be easily grasped by a person and pulled away from second pivot bar 36. A lift-prevention pin 50 is mounted to flat spring member 46 immediately above lower bent end 48 and extending in the opposite direction therefrom. Pin 50 normally extends through an opening 52 in second pivot bar 36 when flat spring member 46 lies flat against second pivot bar 36.

When assembling each second pivot bar 36 with a bracket 24, lower bent end 48 is pulled away from second pivot bar 36, as shown by the dashed lines in FIG. 3, so as to remove lift-prevention pin 50 from opening 52. Then, mounting pins 42 and 44 are inserted within respective slots 26 so as to fall within blind bases 30 thereof. Thereupon, lower bent end 48 is released, so that flat spring member 46 once again lies flat against second pivot bar 36. In this position, lift-prevention pin 50 extends through opening 52 into open mouth 28 of the slot 26. In such position, mounting pins 42 and 44 cannot be removed from slots 26, until lower bent end 48 is once again pulled out so as to remove lift-prevention pin 50 from the blocking relation in open mouth 28.

Thus, with the present invention, upon positioning mounting pins 42 and 44 within respective slots 26, pin 50 automatically enters the open mouth 28 to provide the locking relation. There is thus no need to engage any other hook or the like, as in known assemblies.

Figure 4:
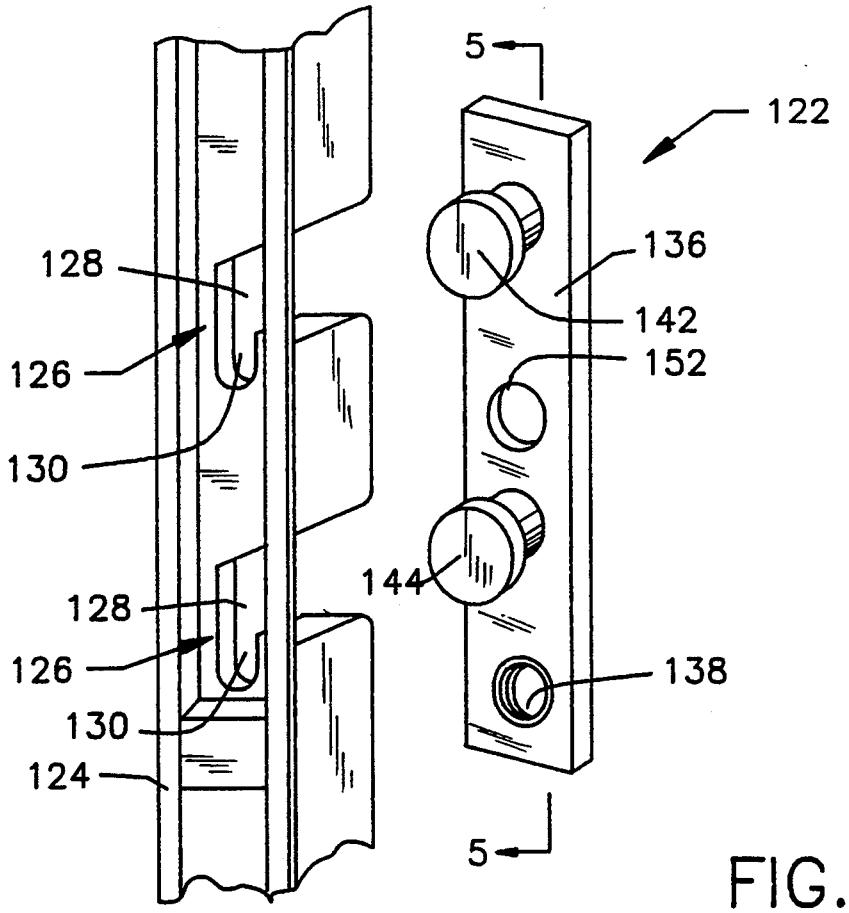
FIG. 4 is an enlarged perspective view of one lock bracket assembly according to another embodiment of the present invention.
Figure 5:
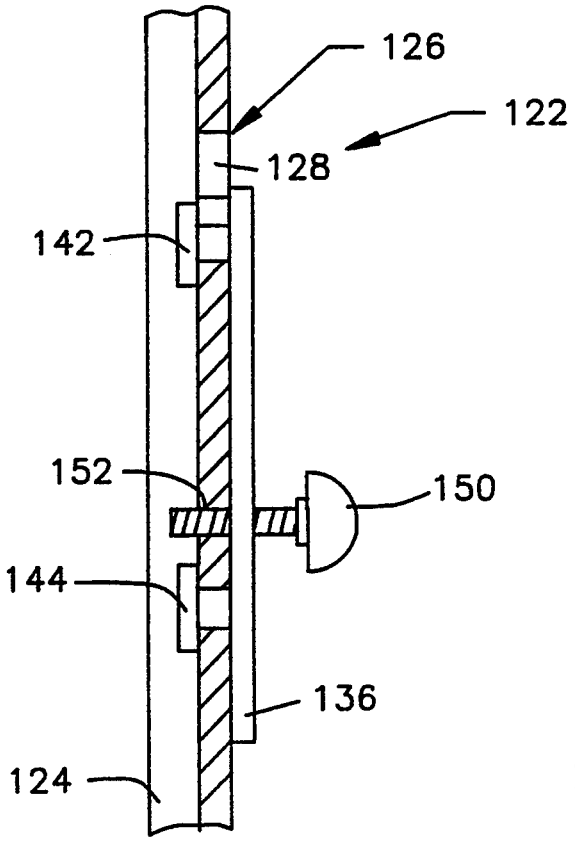
FIG. 5 is a cross-sectional view of the lock bracket assembly of FIG. 4 in assembled condition, taken along line 5—5 thereof.

Referring now to FIGS. 4 and 5, a lock bracket assembly 122 according to a modified embodiment of the present invention will now be described, in which elements corresponding to those of lock bracket assembly 22 are identified by the same reference numerals, augmented by 100, and a detailed description thereof will be omitted herein for the sake of brevity.

Basically, lock bracket assembly 122 is identical to lock bracket assembly 22, except that flat spring member 46 and lift-prevention pin 50 are eliminated. In place thereof, opening 152 is threaded, and a lift-prevention bolt 150 is threadedly received therein so as to extend into the aforementioned locking relation in open mouth 128 after mounting pins 142 and 144 are assembled in slots 126.

With the second embodiment, bolts 150 can be threaded into openings 152 after assembly. Thus, there is no need to hold lower bent ends 48 of springs as in the first embodiment. With this second embodiment, the lift-prevention means is also formed as part of the second pivot bar 136, so that assembly is simplified and the space requirements for assembly are minimized.

Figure 8:
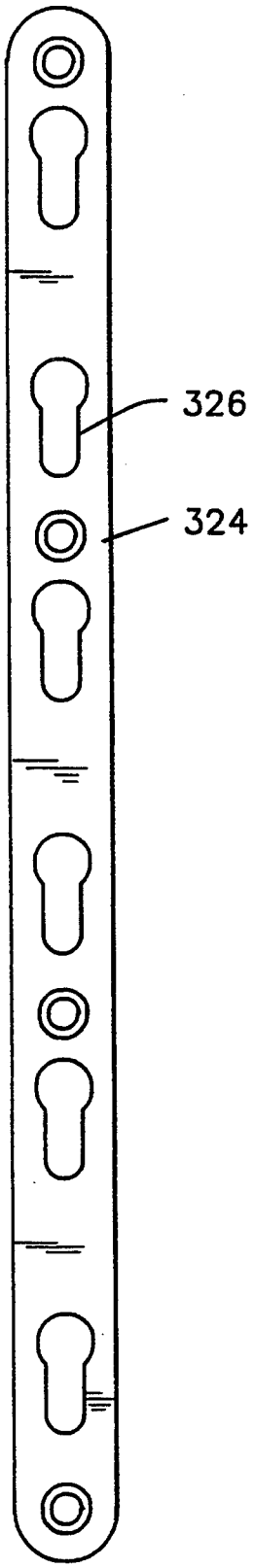
FIG. 8 is a side elevational view of still another standard bar that can be used with the lock bracket assembly according to the present invention.
Figure 7:
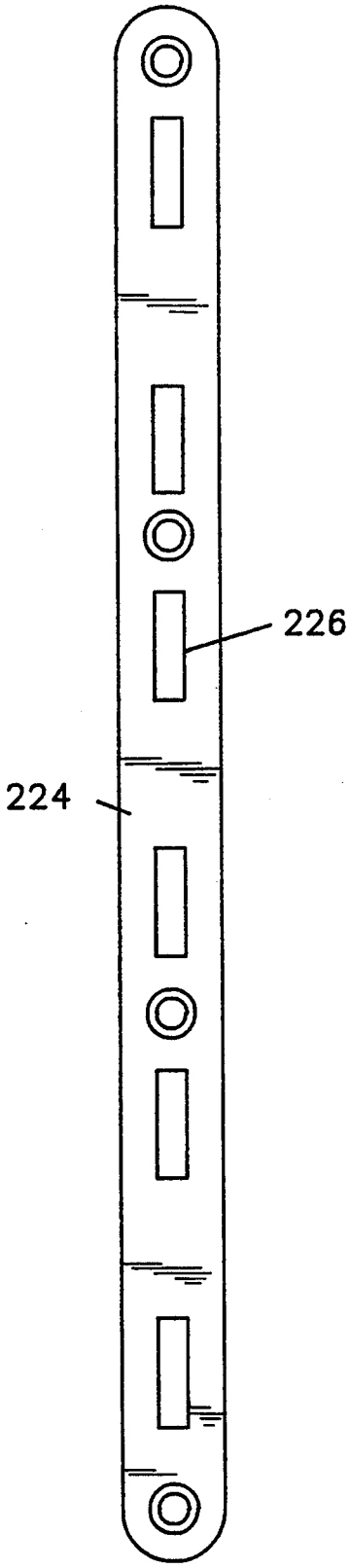
FIG. 7 is a side elevational view of another standard bar that can be used with the lock bracket assembly according to the present invention.
Figure 6:
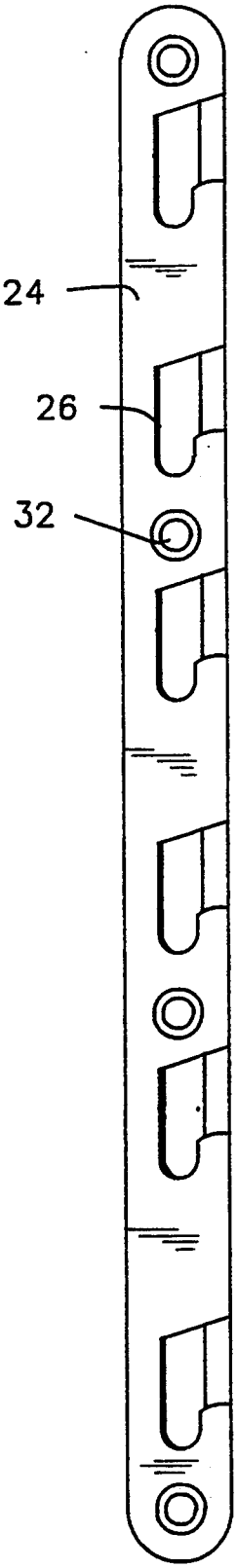
FIG. 6 is a side elevational view of one standard bar of FIG. 1.

It will be appreciated that many modifications can be made to the present invention within the scope of the claims. For example, bracket 24 can be replaced by different standard bars 224 and 324, as shown in FIGS. 7 and 8, having different slots 226 and 326, respectively.

Further, although pin 50 and bolt 150 have been shown being inserted into open mouths 28 and 128, respectively, it is possible to provide separate openings in brackets 24 and 124 for reception of pin 50 and bolt 150 therein.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A lock bracket assembly for securing first and second members together, comprising:

an elongated bracket having a plurality of slots therein secured to said first member, each said slot having an enlarged mouth portion and a lower base portion in open communication with the enlarged mouth portion;

a bar connected with said second member;

at least one mounting pin mounted on said bar for insertion within at least one respective said slot so as to mount said second member to said first member; and lift-prevention means for preventing escape of said at least one mounting pin from said at least one respective slot, said lift-prevention means including:

a lift-prevention opening in said bracket, an extension opening in said bar, and extension means, separate from said pin and connected with said bar, for extending through said extension opening and into said lift-prevention opening when said at least one mounting pin is inserted within said at least one respective slot.

2. A lock bracket assembly according to claim 1, wherein said first member is a headboard of a crib and said second member is a mattress support member of the crib.

3. A lock bracket assembly according to claim 1, wherein said lift-prevention opening is the same as one said open mouth portion.

4. A lock bracket assembly according to claim 1, wherein said first member is a headboard of a crib and said second member is a mattress support member of the crib.

5. A lock bracket assembly according to claim 2, wherein said bar is pivotally connected with said second member.

6. A lock bracket assembly for securing first and second members together, comprising:

an elongated bracket having a plurality of slots therein secured to said first member, each said slot having an enlarged mouth portion and a lower base portion in open communication with the enlarged mouth portion;

a bar connected with said second member;

at least one mounting pin mounted on said bar for insertion within at least one respective said slot so as to mount said second member to said first member; and lift-prevention means for preventing escape of said at least one mounting pin from said at least one respective slot, said lift-prevention means including a lift-prevention opening in said bracket and extension means, which is connected with said bar, for extending into said lift-prevention opening when said at least one mounting pin is inserted within said at least one respective slot;

said at least one mounting pin and said lift-prevention means extending from the same side of said bar.

7. A lock bracket assembly for securing first and second members together, comprising:

an elongated bracket having a plurality of slots therein secured to said first member, each said slot having an enlarged mouth portion and a lower base portion in open communication with the enlarged mouth portion;

a bar connected with said second member;

at least one mounting pin mounted on said bar for insertion within at least one respective said slot so as to mount said second member to said first member; and lift-prevention means for preventing escape of said at least one mounting pin from said at least one respective slot, said lift-prevention means including:

a lift-prevention opening in said bracket, a flat spring member having one end secured to said bar so as to lie against said bar, an opening in said bar, and extension means, which is connected with said bar, for extending into said lift-prevention opening when said at least one mounting pin is inserted within said at least one respective slot, said extension means including a lift-prevention pin secured to a free end of said flat spring member and extending through said opening in said bar for engagement with the lift-prevention opening.

8. A lock bracket assembly for securing first and second members together, comprising:

an elongated bracket having a plurality of slots therein secured to said first member, each said slot having an enlarged mouth portion and a lower base portion in open communication with the enlarged mouth portion;

a bar connected with said second member;

at least one mounting pin mounted on said bar for insertion within at least one respective said slot so as to mount said second member to said first member; and lift-prevention means for preventing escape of said at least one mounting pin from said at least one respective slot, said lift-prevention means including:

a lift-prevention opening in said bracket, a threaded opening in said bar, and extension means, which is connected with said bar, for extending into said lift-prevention opening when said at least one mounting pin is inserted within said at least one respective slot, said extension means including a bolt threadedly engaged with said threaded opening for engagement with the lift-prevention opening.

* * * * *